United States Patent [19]

Steinhäuser et al.

[11] Patent Number: 4,521,001

[45] Date of Patent: Jun. 4, 1985

[54] APPARATUS FOR REMOVING GASES FROM MOLTEN METAL, ESPECIALLY MOLTEN ALUMINUM

[75] Inventors: Thomas Steinhäuser, Meschede; Thomas Büch, Arnsberg, both of Fed. Rep. of Germany

[73] Assignee: Honsel-Werke AG, Meschede, Fed. Rep. of Germany

[21] Appl. No.: 659,660

[22] Filed: Oct. 11, 1984

[51] Int. Cl.[3] ..... F27B 11/08

[52] U.S. Cl. ..... 266/208; 75/68 R

[58] Field of Search ..... 266/207, 208, 209–212; 75/68 R, 93 R, 49

[56] References Cited

U.S. PATENT DOCUMENTS 1,118,820 11/1914 Simpson ..... 266/208

3,958,980 5/1976 Szekely ..... 75/68 R

*Primary Examiner*—Melvyn J. Andrews

*Attorney, Agent, or Firm*—Becker & Becker, Inc.

[57] ABSTRACT

An apparatus for removing gases from molten metal, especially from molten aluminum. A ceramic or similar melting receptacle or crucible is accommodated in a furnace. A partial pressure is produced between the removable cover of the furnace and the surface of the molten material. Between the upper rim surface of the crucible, which is made of ceramic material, and the cover, there is disposed an intermediate ring which supports this cover. A sealing ring is disposed between the intermediate ring and the rim surface of the receptacle. This sealing ring is made at least partially of fibrous material which can resist high temperatures. At a surface pressure of greater than 15 kp/cm$^2$, the sealing ring has a compressibility of at least 10% of its cross-sectional area.

12 Claims, 3 Drawing Figures

APPARATUS FOR REMOVING GASES FROM MOLTEN METAL, ESPECIALLY MOLTEN ALUMINUM

BACKGROUND OF THE INVENTION

The present invention relates to an apparatus for removing gases from molten metal, especially from molten aluminum, in a ceramic melting receptacle or crucible which is accommodated in a furnace, between the detachable cover of which and the surface of the molten material there is produced a partial vacuum.

Apart from removing the gases, especially from molten aluminum, by chlorination or flushing with clorine-releasing agents or gases, from the flushing with inert gases, from the removal of gases by tapping, from the ladle degasification or ladle filtration degasification, from the removal of gases from the individual ingot, and from the circulation degasification, the important methods for removing gases from aluminum casting alloys in the foundry mold are the receptacle degasification and the ladle degasification. The last-mentioned method for removing gases provides for a melting receptacle or crucible which can be closed off by a cover; a bubble lance passes through the cover and extends to the bottom of the receptacle or crucible. A partial vacuum of less than 130 mbar is formed in the space between the cover and the surface of the molten metal, so that bubbles can form which rise in the molten material into the aforementioned space (Giesserei 66 (1979) Nr. 6, pages 56–62). German Patent 32 47 457 discloses a method for removing gases from molten metal, especially from molten aluminum, in a crucible having a cover, and also utilizing a partial pressure between the cover and the surface of the molten material. However, this method omits a bubble lance and uses a crucible having a porous wall through which gases which surround the receptacle enter the molten material and bubble therethrough. An absolute pressure of 50 to 500 mbar is produced between the cover and the surface of the molten material.

The important thing with apparatus where a relatively low partial vacuum is produced between the surface of the molten material and the cover of the melting receptacle or crucible is the tightness of the seal between the cover and the receptacle or crucible. Fluctuations of the partial pressure do not permit reliable removal of gases from the molten material. Even the smallest leaks at the space between the surface of the molten material and the cover allow a great variation of the vacuum to result in this space. Something that has to be taken into consideration in this connection is that the melting receptacle or crucible is generally made of ceramic material having an uneven outer surface, so that an absolute or nearly absolute tight seal can at best be achieved with a very complex arrangement or at high cost.

It is therefore an object of the present invention to provide a sealing arrangement for the space between the cover and the surface of the molten material in the receptacle or crucible, which sealing arrangement is extensively reliable and assures constancy of the partial pressure over a long period of time. At the required partial vacuum, generally in the order of magnitude of from 0.05 to 0.50 bar, no secondary air should enter directly from the outside into the aforementioned space between the surface of the molten material and the cover, thus preventing gas or air from passing through the molten material, be it by the utilization of a lance or on the basis of a porous crucible. It is a further object of the present invention that the means used to accomplish the above be structurally simple and easy to handle.

BRIEF DESCRIPTION OF THE DRAWING

These objects, and other objects and advantages of the present invention, will appear more clearly from the following specification in conjunction with the accompanying drawing, in which.

SUMMARY OF THE INVENTION

Figure 2:
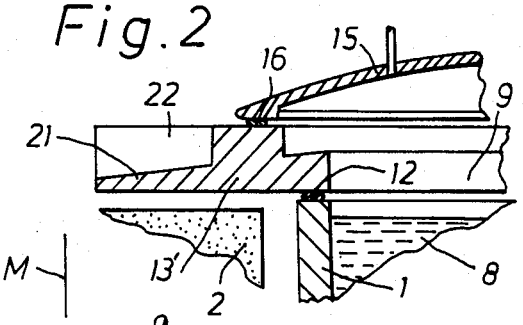
FIGS. 2 and 3 show further embodiments of the upper edge of the inventive intermediate ring, and the connection of the latter with the upper portion of a tilting furnace.

The apparatus of the present invention is characterized primarily in that between the upper rim surface of the crucible, which comprises ceramic material, and the cover, there is disposed an intermediate ring which supports the cover; provided between the intermediate ring and the upper rim surface of the receptacle is a sealing ring which is made entirely or at least partially of fibrous material which is resistant to high temperatures; at a surface pressure of greater than 15 kp/cm$^2$, the sealing ring has a compressibility of at least 10% of its cross-sectional area.

Pursuant to further advantageous features of the present invention, the fibrous material of the sealing ring may be resistant to temperatures of greater than 500° C. The intermediate ring may be made of metal, with both its surface which faces the edge of the cover and its surface which contacts the sealing ring being at least finely machined or finished. The intermediate ring may also be provided with a portion which projects beyond the periphery of the cover and/or the periphery of the crucible. This portion of the intermediate ring may project beyond the periphery of the crucible, and may be provided with ribs.

The intermediate ring may project partially over the upper edge of the furnace, with a gap being left between the upper edge of the furnace and the intermediate ring.

The cover may have a larger diameter than does the crucible.

A gasket which can resist temperatures of 150° to 300° C. can be disposed between te cover and the intermediate ring. The intermediate ring may have an annular rib which can be connected to the upper edge of the furnace by clamping means. The clamping force of these means may be adjustable.

If a tilting furnace is provided, the crucible may be anchored therein, or may be held against the inner walls thereof by spacers.

Except with great expense, it is basically impossible to seal the uneven upper rim surface of the ceramic melting receptacle or crucible so tightly relative to the edge of the cover that not only is the reduction of the low vacuum between the surface of the molten material and the cover avoided, but fluctuations of the vacuum in this space are also prevented. Applying a greater suctioning power to the vacuum line of the receptacle cover does not help either. All this accomplishes is a greater influx of "secondary air", but does not produce the desired suction through the molten material of the gas or air. The amount of air or gas which bubbles through a specific quantity of molten material in a given unit of time can only be controlled and kept constant if the seal of the space between the surface of the molten material and the cover is absolute or nearly absolute.

The present invention proceeds by dividing the seal between the edge of the cover and the rim surface of the receptacle into two seals, each of which essentially takes into account the actual conditions of the contact surfaces adjacent to it as well as the conditions of its immediate surroundings. This means taking into consideration that the edge of the receptacle or crucible has a relatively high temperature, is for the most part uneven, and under these conditions would not permit a good, lasting seal to be achieved if the edge of the cover is frequently removed and again pressed thereagainst. If, however, as proposed by the present invention, a "stationary" seal is utilized between the receptacle or crucible and the intermediate ring, this seal can for all times be adapted to the unevenness of the ceramic rim surface, and this shape can then remain. The seal between the finely or very finely machined or finished surfaces of the intermediate ring and the cover then only represents a secondary problem to one skilled in the art of finely or very finely machined contact surfaces at lower temperatures.

DESCRIPTION OF PREFERRED EMBODIMENTS

Referring now to the drawing in detail, the melting receptacle or crucible 1 used with the inventive apparatus comprises ceramic porous material, and is placed in the furnace 2 in such a way that it is surrounded on all sides by the furnace wall 3 and the furnace bottom 4. The crucible 1 rests upon a support 5, so that air or gas from the space 6 between the crucible 1 and the wall 3 or the bottom 4 of the furnace can pass through the porous wall of the receptacle 1, and can bubble in the direction of the arrows 7 through the molten material 8 in the receptacle 1, in order to pass into the space 9 above the surface 10 of the molten material. For this purpose, the support 5 can be appropriately designed, for example, can be gas permeable.

In a different embodiment of the inventive apparatus, the crucible 1 is not, or is essentially not, formed of porous material, and a lance conveys air or the gas, preferably inert gas, into the lower region 8*a* of the molten material, from where the air or the gas bubbles in a similar manner through the molten material into the space 9, thus removing gas from the molten material in the receptacle 1.

The upper end 11 of the ceramic receptacle 1 naturally has an uneven surface. Placed thereon is a sealing ring 12 which will be described in detail subsequently. An intermediate ring 13 is disposed on the sealing ring 12 between the end wall 11 of the receptacle and the edge 14 of the cover 15. A further gasket 16 is disposed between the intermediate ring 13 and the cover edge 14. A vacuum line 17 opens out into the cover 15, and is intended for the production of a partial vacuum in the order of magnitude of 0.05 to 0.50 bar in the space 9 between the surface 10 of the molten material and the cover 15.

At least at the end 11 of the crucible 1, the intermediate ring 13 preferably has on its underside a finely or even very finely finished or machined surface 18 on which rest the sealing ring 12, so that toward the bottom the latter rests against the uneven end 11 of the receptacle 1 and toward to top preferably rests against the smooth surface 18 of the intermediate ring 13. A worse embodiment would be to have the underside of the intermediate ring 13, at the end 11 of the receptacle 1, remain for the most part rough or not machined.

The sealing ring 12 has a certain amount of compressibility in order to be able to compensate for the unevenness of the end 11 of the receptacle 1 in such a way that the seal 12 between the end 11 and the intermediate ring 13 allows an absolute or nearly absolute sealing of the space 9 to be achieved. Taking into consideration the weight of the cover 15, at a surface pressure of greater than 15 kp/cm$^2$, the sealing ring 12 should have a compressibility of at least 10% of its cross-sectional area. In other words, when the cover 15 and the intermediate ring 13 are placed upon the sealing ring 12, the latter should be deformable in such a way that the unevenness of the end 11 of the receptacle 1 can be completely compensated for thereby. The sealing ring 12 should furthermore be able to withstand temperatures of at least 500° C. For this purpose, the intermediate ring 13 is completely or partially comprised of high-heat resistant fibrous material having the required binder. Along with the intermediate ring 13, the sealing ring 12 remains permanently on the receptacle end 11, so that once it has assumed its position and shape it retains the latter, and it only obtains a first and single deformation for compensating the unevenness of the end 11 of the receptacle 1 once, namely when the intermediate ring 13 is placed upon the receptacle 1. As a result, the sought-after high sealing ability of the ring 12 relative to the uneven end 11 of the receptacle 1 is assured for a long period of time.

In contrast, the cover 15 must, of course, be removed numerous times from the receptacle, and again placed thereon. In order here also to be able to achieve a very good seal, which guarantees the desired low partial pressure in the space 9 between the surface 10 of the molten material and the cover 15, that contact surface 20 of the ring 13 which faces the cover edge 14 is at least finely machined, and is preferably very finely machined or finished; the edge 14 of the cover 15 also preferably receives a very fine finish. The sealing ring or gasket 16, which essentially only has to resist temperatures of 150° to 300° C., is thus disposed between two completely smooth surfaces at a reduced temperature, since the intermediate ring 13 has a cooling-off effect, especially when it has the configuration which is to be subsequently described.

The intermediate ring 13 has a circumference which forms the radially outer portion 21 and is greater than the outer circumference of the crucible 1. Pursuant to a further advantageous embodiment, which is illustrated in FIG. 2, the intermediate ring 13' is provided at the radial outer portion 21 thereof with radial ribs 22 having spaces therebetween. As a result, the intermediate ring 13' forms a cooling element, so that the sealing ring 16 is disposed on a cooled part, namely the intermediate ring 13'. In place of the radial ribs 22, annular ribs could also be provided on the portion 21.

The contact surface 20 of the intermediate ring 13 is disposed at the greater distance from the central axis M of the crucible 1 than is the outer circumference of this receptacle. A line 24 for a thermometer 25 which is immersed in the molten material 8 is guided through the annular rib 23 which forms the contact surface 20 of the intermediate ring 13.

Figure 1:
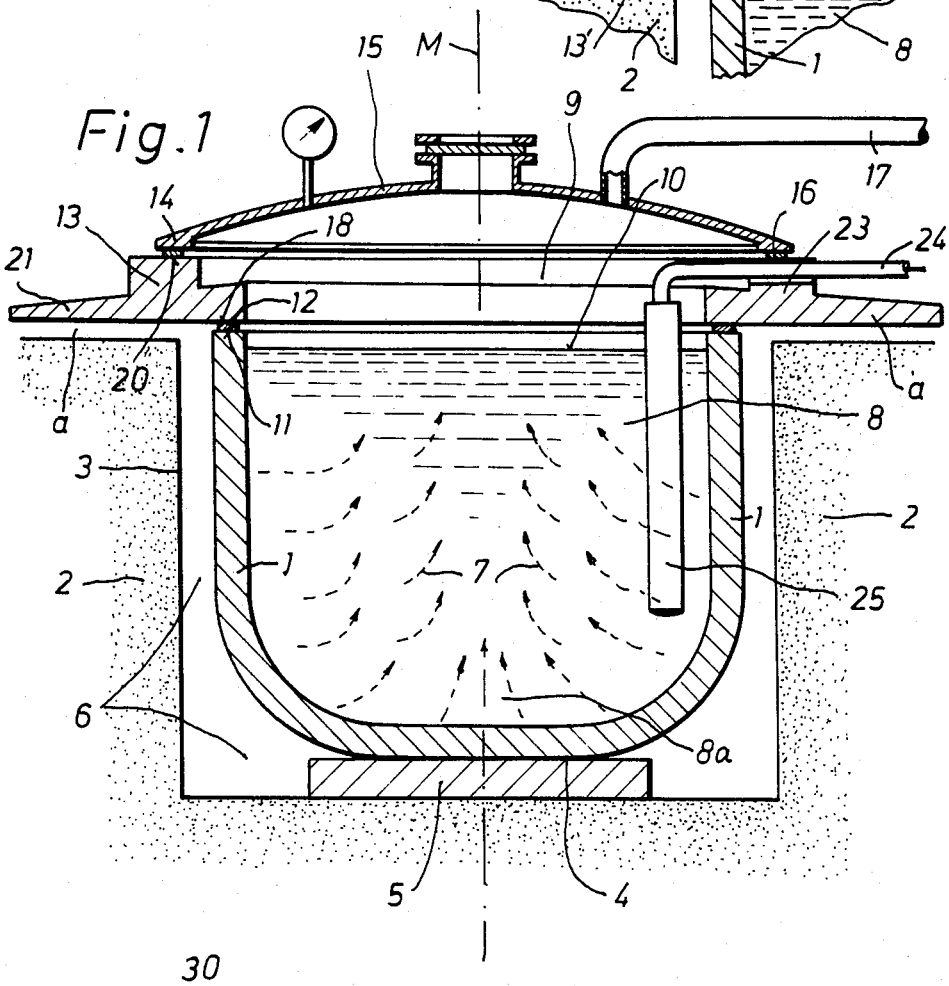
FIG. 1 is a vertical section through one embodiment of the apparatus of the present invention.
Figure 3:
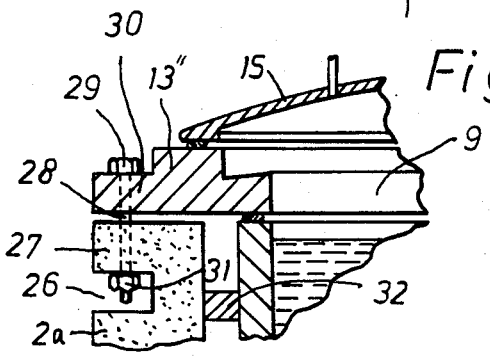

In the embodiment of FIG. 3, the receptacle 1 is disposed in a furnace 2*a* which has an annular rib 27 above an annular recess 26. Extending through the ribs 27 are bolts 28 which form clamping means. The heads 29 of the bolts 28 rest against a portion 30 of the intermediate ring 13", while the nuts 31 of the bolts 28 rest against the underside of the ribs 27. In this manner, the intermediate ring 13 is rigidly connected to the furnace. Therefore, when the furnace 2*a* is tilted or pivoted, the ring 13" is rigidly held. The receptacle, in turn, is securely held in position within a tilting furnace by suitable spacers 32, so that there is again assured that the sealing ring 12 between the end 11 of the crucible 1 and the intermediate ring 13" always irreversibly retains the condition it originally obtained when the intermediate ring 13" was placed on the receptacle; the ring 12 does not relinquish its deformation on the uneven end 11 once it has acquired the same. In other respects, the parts of the embodiment illustrated in FIG. 3 correspond to those of the embodiment illustrated in FIG. 1. With the aid of the bolts 28, the bearing pressure of the intermediate ring 13" on the sealing ring 12, and the pressure of the latter on the end 11, can be adjusted.

Sufficient gap "a" is provided between the intermediate ring 13 and the top of the furnace 2 so that when the receptacle 1 contracts, a resting of the intermediate ring 13 on the furnace 2 is avoided.

The present invention is, of course, in no way restricted to the specific disclosure of the specification and drawing, but also encompasses any modification within the scope of the appended claims.

What we claim is:

1. An apparatus for removing gases from molten metal, especially from molten aluminum, contained in a ceramic melting receptacle which is accommodated in a furnace; said melting receptacle has a bottom, sides, is open at the top, and has upper rim surfaces on said sides adjacent to said open top; said furnace is provided with a removable cover; a partial vacuum is produced between said cover and the surface of said molten metal; the improvement comprising:

an intermediate ring, which is disposed between said upper rim surface of said receptacle and said cover, and is adapted to support the latter; and a sealing ring disposed between said intermediate ring and said upper rim surface of said receptacle; said sealing ring is comprised at least partially of fibrous material which can withstand high temperatures; at a surface pressure of greater than 15 kp/cm$^2$ on said sealing ring, the latter has a compressibility of at least 10% of its cross-sectional area.

2. An apparatus according to claim 1, in which said sealing ring is comprised of a material which can withstand temperatures of greater than 500° C.

3. An apparatus according to claim 2, in which said intermediate ring is comprised of metal and has a first contact surface which faces an edge of said cover, and a second contact surface which faces said upper rim surface of said receptacle; said first and second contact surfaces are at least finely finished.

4. An apparatus according to claim 3, which includes a gasket disposed between said cover and said intermediate ring, said gasket being adapted to withstand temperatures of from 150° to 300° C.

5. An apparatus according to claim 3, in which said intermediate ring is provided with a portion which projects radially outwardly beyond at least one of the peripheries of said cover and said receptacle.

6. An apparatus according to claim 5, in which said portion of said intermediate ring projects beyond the periphery of said receptacle and is provided with ribs.

7. An apparatus according to claim 5, in which said intermediate ring projects partially over an upper edge of said furnace in such a way as to leave a gap between them.

8. An apparatus according to claim 3, in which said cover has a diameter which is greater than the diameter of said receptacle.

9. An apparatus according to claim 3, in which said furnace has an upper edge in the form of an annular rib; and which includes clamping means for connecting said intermediate ring to said annular rib of said furnace.

10. An apparatus according to claim 9, in which said clamping means has an adjustable clamping force.

11. An apparatus according to claim 1, in which said furnace is a tilting furnace, and in which said melting receptacle is anchored in said furnace.

12. An apparatus according to claim 1, in which said furnace is a tilting furnace, and in which said melting receptacle is held against inner walls of said furnace via spacers.

* * * * *